US007920038B1

(12) United States Patent
Knauer

(10) Patent No.: US 7,920,038 B1
(45) Date of Patent: Apr. 5, 2011

(54) DUAL SHIELDED RELAY

(75) Inventor: William Knauer, Chagrin Falls, OH (US)

(73) Assignee: Keithley Instruments, Inc., Cleveland, OH (US)

( * ) Notice: Subject to any disclaimer, the term of this patent is extended or adjusted under 35 U.S.C. 154(b) by 109 days.

(21) Appl. No.: 12/123,848

(22) Filed: May 20, 2008

(51) Int. Cl.
*H01H 1/66* (2006.01)

(52) U.S. Cl. ..... 335/151

(58) Field of Classification Search ..... 335/151–154
See application file for complete search history.

(56) References Cited

U.S. PATENT DOCUMENTS 5,438,307 A * 8/1995 Chou ..... 335/151
5,559,482 A 9/1996 Close et al.
5,963,116 A * 10/1999 Endoh et al. ..... 335/151
6,025,768 A * 2/2000 Martich ..... 335/152
6,271,740 B1 * 8/2001 Chikamatsu ..... 335/151
RE38,381 E * 1/2004 Martich ..... 335/151
6,683,518 B2 * 1/2004 Motta ..... 335/151

* cited by examiner

*Primary Examiner* — Anh T Mai
*Assistant Examiner* — Bernard Rojas
(74) *Attorney, Agent, or Firm* — Pearne & Gordon LLP

(57) ABSTRACT

Provided is a relay that includes first and second contacts that are selectively connectable for closing an electric circuit. A coil wound around the contacts along a longitudinal axis can generate a magnetic field that connects the contacts in one of an energized or de-energized state and disconnects the contacts in the other of the energized or de-energized state. A first electrically conductive shield is provided adjacent to a first end of the relay and electrically connected to the first contact, and a second electrically conductive shield, the second electrically conductive shield being electrically connected to the second contact. The first electrically conductive shield extends at least partially around the first contact and the second electrically conductive shield extends at least partially around the second contact. The second electrically conductive shield is substantially coaxial with the first electrically conductive shield and separated a distance apart from the first electrically conductive shield along the longitudinal axis.

10 Claims, 2 Drawing Sheets

DUAL SHIELDED RELAY

BACKGROUND OF THE INVENTION

1. Field of the Invention

The present invention is directed generally toward low current switching devices and, more specifically, to a dual-shielded reed relay for surface mount applications.

2. Description of Related Art

Switching applications commonly use reed relays for connecting or disconnecting selected circuits. Typically, as shown in FIG. 1, a reed-type switch includes a pair of switching contacts 1, 2 that are supported by adjustable switching elements 9 made from a magnetic material. The contacts 1, 2 and their switching elements 9 are surrounded by and actuated by an electrically-magnetized operating coil (not shown). For example, each of the contacts 1, 2 are adjustable, but normally separated from each other in a switching state referred to as "open," so that the lead 3, 4 associated with each contact 1, 2 of the relay is electrically disconnected from the other. Such a reed-type switch is referred to as being normally open. When the coil is energized, the magnetic field generated urges the switching elements inward, causing the contacts 1, 2 to be placed in contact with each other, thereby electrically connecting the leads 3, 4.

Reed relays are used in low current switching assemblies adapted to connect selected circuits 5 in an equipment testing environment to a signal measurement unit 6. Circuits 5 of a device under test are connected to a switching matrix that includes a plurality of relay assemblies. Test equipment 6 is also connected to the matrix such that selected circuits of the device under test are connectable to selected test equipment inputs by operation of the relays. In such a testing environment, a high degree of accuracy and consistency is desirable in the signals conducted through the relays to achieve accurate test results. But because the currents tend to be very low (on the order of $1\times10^{-15}$ A), the signals are susceptible to even small amounts of interference and leakage.

Insulation and shielding can reduce interference and leakage. For example, the reed switch in FIG. 1 includes a single copper foil shield 7 that has been connected to one of the switching element leads by a jumper 8 and wrapped around the entire reed-type switch, including both switching element contacts 1, 2. The foil shield 7 is electrically connected to conduct a "guard" signal during testing to minimize the leakage through the contact 2 and its associated lead 4 during testing. However, when the contacts 1, 2 in FIG. 1 are electrically disconnected and form part of a test matrix, leakage can occur through the lead 3 electrically connected to the test measurement unit 6. Moreover, the shield 7 is formed from an electrically conductive material which, when wrapped around the contacts 1, 2 can create a possibility of shorting adjacent on a printed circuit board if the shield makes contact with those traces. This possibility has limited the types of applications in which the relay can be employed because a pin connector is required to be provided to the relay for connecting the relay to printed circuit boards ("PCBs") and suspending the conductive shield 7 above the PCB to insulate the shield 7 from the traces on the PCB. Additionally, through-pin connectors for mounting electronic components to a PCB is labor intensive, and expensive.

Installing a circuit component with a pin connector on a PCB requires manual insertion of the component onto the board such that the pins are inserted through plated holes. Once properly positioned, solder or other conductive adhesive is used to solder the pins to the plating lining the holes or a pad on the surface of the PCB to permanently affix the component to the PCB. Such pin-connector components not only add to the cost of assembly, but consume significant real estate on the PCB, and require expensive manufacturing and packaging techniques to bring components to market.

Accordingly, there is a need in the art for a reed relay that is surface mountable, yet shielded to minimize current leakage during low-current applications.

BRIEF SUMMARY OF THE INVENTION

According to one aspect, the present invention provides a relay comprising first and second contacts, said contacts being selectively connectable for closing an electric circuit. A coil is wound around the contacts along a longitudinal axis to generate a magnetic field that connects the contacts in one of an energized or de-energized state and disconnects the contacts in the other of the energized or de-energized state. A first electrically-conductive shield is provided adjacent to a first end of the relay and electrically connected to the first contact, the first electrically conductive shield extending at least partially around a switching element supporting the first contact. A second electrically conductive shield is also electrically connected to the second contact and extends at least partially around a switching element supporting the second contact. The second electrically conductive shield is substantially coaxial with the first electrically conductive shield and separated a distance apart from the first electrically conductive shield along the longitudinal axis. The relay further comprises a plurality of surface mountable pads, each electrically connected to a separate one of the first contact, the second contact and opposite ends of the coil for surface mounting the relay to a printed circuit board without penetrating the printed circuit board.

According to another aspect, the present invention provides a relay comprising first and second contacts hermetically sealed within a dielectric housing, the first and second contacts being selectively connectable for closing an electric circuit. A bobbin at least partially encircles the first and second contacts and comprises an outwardly extending flange at each opposite end thereof. A coil is wound around the bobbin and between the flanges along a longitudinal axis to generate a magnetic field that connects the contacts in one of an energized or de-energized state and disconnects the contacts in the other of the energized or de-energized state. A first electrically-conductive shield is provided adjacent to a first end of the relay and electrically connected to the first contact, and extends at least partially around a switching element supporting the first contact. Likewise, a second electrically-conductive shield is electrically connected to the second contact and extends at least partially around a switching element supporting the second contact. The second electrically conductive shield is separated a distance apart from the first electrically conductive shield along the longitudinal axis to form an air gap between the first and second electrically conductive shields. A plurality of surface mountable pads are also provided, each being electrically connected to a separate one of the first contact, the second contact and opposite ends of the coil for surface mounting the relay to a printed circuit board.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF ILLUSTRATIVE EMBODIMENTS

Figure 1:
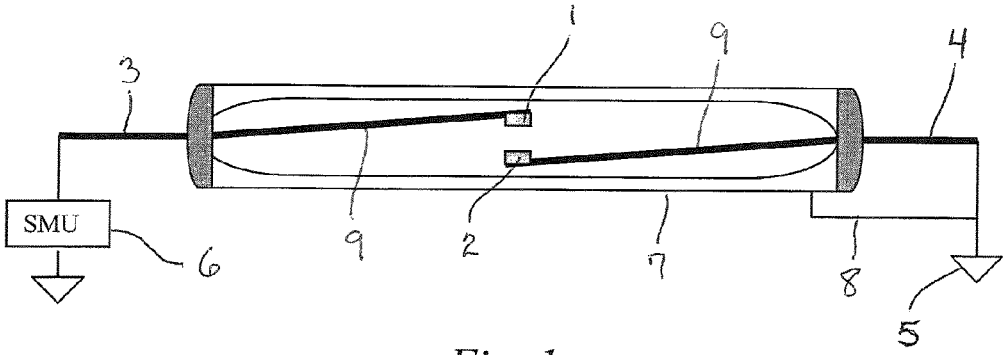
Fig. 1 (Prior Art)
FIG. 1 shows a schematic view of a conventional single shielded reed relay for selectively establishing an electrical connection between a device under test and a signal measurement unit.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of" followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Figure 2:
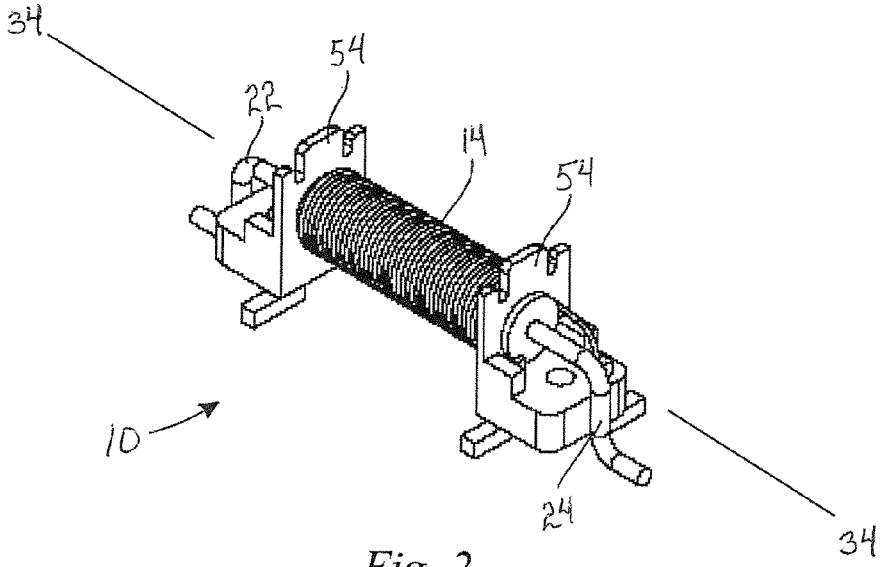
FIG. 2 shows a perspective view of a surface mountable, dual-shielded reed relay according to an embodiment of the present invention.
Figure 3:
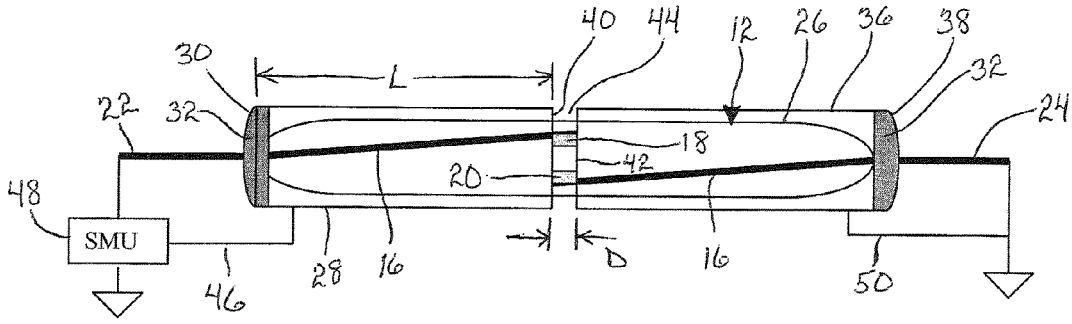
FIG. 3 shows a schematic representation of a dual-shielded reed relay according to an embodiment of the present invention.

FIGS. 2 and 3 illustrate a reed relay 10 including a reed switch 12 at least partially surrounded by an operator coil 14. The reed switch 12 comprises one or more sets of magnetic switching elements 16, each provided with a contact 18, 20, preferably hermetically sealed within insulation 26. To clearly illustrate the present invention the switching elements 16 and contacts 18, 20 will be described as normally open, meaning that when the operator coil 14 is not energized (i.e., current is not being actively delivered to the coil) the switching elements 16 will not be magnetically urged together, but instead spaced apart to separate the contacts 18, 20. According to such an arrangement, one switching element 16 can be held stationary while the other is allowed to pivot under the forces imparted by the magnetic field generated by the coil 14. According to alternate embodiments, both switching elements 16 can pivot under the forces imparted by the magnetic field generated by the coil 14 to selectively bring the contacts 18, 20 to electrically connect first and second leads 22, 24, as described in detail below. However, it is noted that normally-closed and any other switching modes are also encompassed within the scope of the present invention.

The contacts 18, 20 can be any suitable metallic or other electrically conductive surfaces provided adjacent to the end of each switching element 16. Examples of such materials include, but are not limited to rhodium and iridium, for example. The contacts 18, 20 are electrically connected to first and second leads 22, 24, respectively, via the switching elements 16.

The switching elements 16 and contacts 18, 20 are enclosed in insulation 26 of suitable material such as glass, resin, or a polymer, for example. Preferably, two, three or more of these sets of switching elements 16 and contacts 18, 20, each enclosed by their own respective insulation 26 enclosure are at least partially surrounded by a common coil 14, a configuration herein as a "reed pack", to selectively switch two, three or more electric circuits through the operation of the common operator coil 14. An example of a reed pack can be found in U.S. Pat. No. 5,559,482 to Close et al., which is incorporated in its entirety herein by reference. But for the sake of brevity the present invention is described herein as including a single insulation enclosure encasing one set of switching elements 16 supporting contacts 18, 20.

The reed relay 10 includes a first shield 28 formed from copper foil, a copper extrusion layer, or any other form or any other suitable electrically-conductive material wrapped at least partially, and preferably entirely around a longitudinal axis 34-34 of the relay, externally of the insulation 26 in which the contacts 18, 20 are hermetically sealed. The first shield 28 forms a substantially cylindrical tube provided adjacent to a first end 30 of the insulation 26 of the reed switch 12. Potting compound 32 or other suitable dielectric material can be used to seal the outermost end of the first shield 28, which is the end of the first shield 28 closest to the first end 30 of the reed switch 12, and couple the first shield 28 to the reed switch 12.

A second electrically-conductive shield 36 formed from copper foil, a copper extrusion layer, or any other form or any other suitable electrically-conductive material is also wrapped at least partially, and preferably entirely around the longitudinal axis 34-34 of the relay 10, externally of the insulation 26 in which the contacts 18, 20 are hermetically sealed. The second shield 36 also forms a substantially cylindrical tube, but it is provided adjacent to a second end 38 of the insulation 26 of the reed switch 12. Similar to the first shield 28, potting compound 32 or other suitable dielectric material can again be used to seal the outermost end of the second shield 36, which is the end of the second shield 36 closest to the second end 38 of the reed switch 12, and couple the second shield 36 to the reed switch 12.

The first shield 28, with its outermost end sealed with the potting compound 32, forms a generally tubular cylinder with its open end 40 facing the second end 38 of the reed relay 12. Likewise, the second shield 36 is arranged similar to a mirror image of the first shield 28 along the longitudinal axis 34-34. In other words, the second shield 28, with its outermost end sealed with the potting compound 32, also forms a generally tubular cylinder with its open end 42 facing the first end 30 of the reed relay 12. So arranged, the first and second shields 28, 36 are oriented such that their respective open ends 40, 42 face each other.

The first and second shields 28, 36 are arranged to be substantially coaxial, and preferably substantially concentric along the longitudinal axis 34-34. In the substantially coaxial arrangement, both the first and second shields 28, 36 extend substantially, and preferably almost entirely around the longitudinal axis 34-34, although one or both may not be positioned with their central axis disposed along the longitudinal axis 34-34. Thus, in such an arrangement the first and second shields 28, 36 may at least partially extend around the longitudinal axis 34-34, but may not be perfectly aligned. If substantially concentrically arranged, the first and second shields 28, 36 are both arranged such that each of their respective central axes falls just about along the longitudinal axis 34-34 of the reed relay 10.

Of course other embodiments can optionally include a dielectric material to one or both of the "open" ends 40, 42 of the first and second shields 28, 36, respectively, to provided added support to the first and second shields 28, 36. For such embodiments the "open" ends 40, 42 are not necessarily open, but are still referred to as such herein.

The first and second shields 28, 36 are arranged along the longitudinal axis, but laterally spaced a distance D apart from each other, leaving a gap 44 there between where the first and second shields 28, 36 do not overlap. The gap 44 can be an open, air-filled void between the first and second shields 28, 36. Any dielectric material provided to the open ends 40, 42 of the first and second shields 28, 36 or to any other portion of the reed relay 10 does not bridge the gap 44 between the first and second shields 28, 36. Thus, the gap 44 is substantially devoid of any dielectric material between the first and second shields 28, 36.

As shown in FIG. 3, the first shield 28 extends substantially around the switching element 16 supporting the first contact 18, while the second shield 36 extends substantially around the switching element 16 supporting the second contact 20. The gap 44 separating the first and second shields 28, 36 is formed along the portion of the longitudinal axis 34-34 where the portions of the switching elements 16 overlap to make contact with each other when the coil 14 is energized.

With the gap 44 in the form of an air-filled void between the first and second shields 28, 36, the maximum potential difference between the first and second shields 28, 36 can be selected as desired by adjusting the distance D between the first and second shields 28, 36. Air has a known resistance to conducting electric current, which is dependent on factors such as the relative humidity of the air in the gap 44, for example. Taking this known resistance of air into consideration, the distance D of the gap 44 can be adjusted to provide the reed relay 10 with a desired isolation voltage between the first and second shields 28, 36. The maximum isolation voltage is the maximum potential difference that can be established between the first and second shields 28, 36 before an arc discharge occurs across the gap 44. And to enhance the electrostatic insulation properties of the reed relay 10, the length L of each of the first and second shields 28, 36 is significantly longer than a thickness of the insulation 26 enclosing the contacts 18, 20.

The first shield 28 is positioned toward and electrically connected to the first lead 22, which is electrically connected to the contact 18 supported by the switching element 16. The electrical connection between the first shield 28 and the first lead 22 can be established by, for example, a first jumper 46 soldered to the first shield 26 and the first lead 22. According to alternate embodiments the electrical connection between the first shield 28 and the first lead 22 can be established by, for example, a first jumper 46 soldered to the first shield 26 at one end and to any portion of a signal measurement circuit, including a signal measuring unit 48 for measuring a signal conducted by a circuit provided to the device under test (not shown) that is electrically connected to the signal measuring unit 48 by the reed relay 10.

The second shield 36 is positioned toward and electrically connected to the second lead 24, which is electrically connected to the contact 20 supported by the switching element 16. The electrical connection between the second shield 36 and the second lead 24 can be established by, for example, a second jumper 50 soldered to the second shield 26 at one end and to the second lead 24 at the other end. According to alternate embodiments the electrical connection between the second shield 36 and the second lead 24 can be established by, for example, the second jumper 50 soldered to the second shield 26 at one end and to any portion of a circuit corresponding to a device under test (not shown) that is electrically connected to the signal measuring unit 48 by the reed relay 10.

Figure 4:
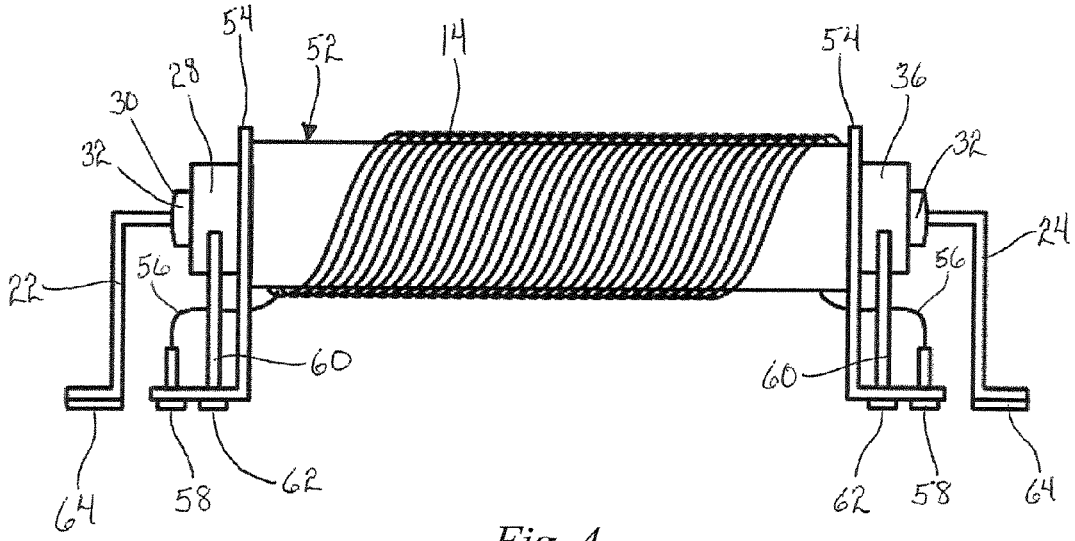
FIG. 4 shows a side view of a dual-shielded reed relay according to an embodiment of the present invention.

Referring to FIG. 4, the reed switch 12 and associated first and second shields 28, 36 is inserted in a bobbin 52. The bobbin 52 includes a flange 54 that extends outwardly, in a radial direction away from the longitudinal axis 34-34 on each end of the bobbin 52, and is wound with an operator, such as the operating coil 14 between the flanges 54. Each end of the coil 14 is connected to a coil lead 56 that establishes an electrical connection to a surface mount pad 58 to be soldered to a similar surface mountable region on the PCB of an operating circuit (not shown) that delivers electric current to energize the coil 14.

While inserted in the bobbin 52, the outermost ends of the first and second shields 28, 36 extend beyond the limits of the bobbin 52, exposing a portion of their metallic surface. The portion of the exposed metallic surface of the first and second shields 28, 36 can optionally extend entirely around the longitudinal axis 34-34, thereby exposing a metallic ring around the longitudinal axis 34-34 outside of the bobbin 52. According the alternate embodiment shown in FIG. 4, instead of using the jumpers 46, 50 to electrically connect the first and second shields 28, 36 to the leads 22, 24, respectively, this electric connection can optionally be established by a jumper 60 between the exposed metallic ring portion of the first and second shields 28, 36 and respective surface mount pads 62. The surface mount pads 62 can each be soldered to a similar surface mountable region of a PCB that is shorted to a surface mountable region to which the first and second leads 22, 24 are to be soldered.

Leads 22, 24 electrically connected to the contacts 18, 20 are also provided with surface mount pads 64 to facilitate surface mounting of the reed relay 10 to circuits to be controlled or switched. For a normally-open reed switch, when the coil 14 is energized, the switching elements 16 are urged under the force of the magnetic field generally towards each other to bring the contacts 18, 20 together from their open positions and thereby connect the respective leads 22, 24 and their associated circuits. For a normally-closed reed switch, when the coil 14 is energized the switching elements 16 are urged under the force of the magnetic field to separate, and thereby space the contacts 18, 20 apart from each other to electrically disconnect the respective leads 22, 24 and their associated circuits.

When the contacts 18, 20 are brought together to establish an electric connection between the first and second leads 22, 24, a switch (not shown) electrically connects the first and second shields 28, 36 together as well. This switch can be any suitable switch, such as a reed-type switch that can be included in a reed pack, for example. Other embodiments include a dedicated, external switch to create the electric connection between the first and second shields 28, 36 when the contacts 18, 20 are closed. Thus, when the contacts 18, 20 are conducting a signal between the first and second leads 22, 24, the shields conduct a guard signal having the same voltage as the signal being conducted by contacts 18, 20 and switching elements 16.

When the contacts 18, 20 are open (i.e., no electric connection between the contacts 18, 20), the electric connection between the first and second shields is broken. In such situations, the first shield 28 has the same voltage as the first lead 22 relative to a reference voltage due to the presence of the first jumper 46 extending between the first shield 28 and first lead 22. Likewise, when the contacts 18, 20 are open, the second shield 36 has the same voltage as the second lead 24 relative to a reference voltage due to the presence of the second jumper 50 extending between the second shield 36 and second lead 24.

The first and second shields 28, 36 reduce current leakage, static, and interference in the switching elements 16, and accordingly, the contacts 18, 20. Connecting the first and second shields 28, 36 to opposite leads 22, 24 provides balanced and improved shielding over single shield configurations, especially where the leads are connected to neutral or shielding conductors of the switched circuit. Improved accuracy is achieved, particularly in low current applications.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention.

What is claimed is:

1. A relay, comprising:

first and second contacts, said contacts being selectively connectable for closing an electric circuit;

a coil wound around the contacts along a longitudinal axis to generate a magnetic field that connects the contacts in one of an energized or de-energized state and disconnects the contacts in the other of the energized or de-energized state;

a first electrically conductive shield provided adjacent to a first end of the relay and electrically connected to the first contact, the first electrically conductive shield extending at least partially around a switching element supporting the first contact;

a second electrically conductive shield, the second electrically conductive shield being electrically connected to the second contact and extending at least partially around a switching element supporting the second contact, wherein the second electrically conductive shield is substantially coaxial with the first electrically conductive shield and separated a distance apart from the first electrically conductive shield along the longitudinal axis;

a plurality of surface mountable pads, each electrically connected to a separate one of the first contact, the second contact and opposite ends of the coil for surface mounting the relay to a printed circuit board without penetrating the printed circuit board; and wherein the distance separating the first shield from the second shield forms an air gap across which the first and second electrically conductive shields do not overlap and are not electrically connected across said air gap.

2. The relay according to claim 1, wherein the first and second electrically conductive shields are substantially concentrically aligned along the longitudinal axis.

3. The relay according to claim 1, wherein the air gap spans an extent of the longitudinal axis corresponding to an overlap of the first and second contacts when the first and second contacts are connected.

4. The relay according to claim 1, wherein the first and second electrically conductive shields comprise copper foil.

5. The relay according to claim 1 further comprising a dielectric housing encapsulating the first and second contacts; and potting material provided adjacent to outermost ends of each of the first and second electrically conductive shields to establish a fixed relationship between the first and second electrically conductive shields and the dielectric housing.

6. A relay, comprising:

first and second contacts hermetically sealed within a dielectric housing, the first and second contacts being selectively connectable for closing an electric circuit;

a bobbin that at least partially encircles the first and second contacts and comprises an outwardly extending flange at each opposite end thereof;

a coil wound around the bobbin and between the flanges along a longitudinal axis to generate a magnetic field that connects the contacts in one of an energized or de-energized state and disconnects the contacts in the other of the energized or de-energized state;

a first electrically conductive shield provided adjacent to a first end of the relay and electrically connected to the first contact, the first electrically conductive shield extending at least partially around a switching element supporting the first contact;

a second electrically conductive shield, the second electrically conductive shield being electrically connected to the second contact and extending at least partially around a switching element supporting the second contact, wherein the second electrically conductive shield is separated a distance apart from the first electrically conductive shield along the longitudinal axis to form an air gap between the first and second electrically conductive shields, said first and second electrically conductive shields not being electrically connected across said air gap; and a plurality of surface mountable pads, each electrically connected to a separate one of the first contact, the second contact and opposite ends of the coil for surface mounting the relay to a printed circuit board.

7. The relay according to claim 6, wherein at least one of the first and second electrically conductive shields comprises copper foil.

8. The relay according to claim 6, wherein at least one of the first and second electrically conductive shields is a metallic cylinder that extends substantially entirely around the longitudinal axis.

9. The relay according to claim 6, wherein the first and second electrically conductive shields are coaxially aligned along the longitudinal axis, and the distance separating the first shield from the second shield forms an air gap across which the first and second electrically conductive shields do not overlap.

10. The relay according to claim 9, wherein the first and second electrically conductive shields are concentrically aligned along the longitudinal axis.

* * * * *